United States Patent [19]

Elvander et al.

[11] Patent Number: 5,013,355

[45] Date of Patent: May 7, 1991

[54] METHOD AND APPARATUS FOR PRODUCING MATTE AND/OR METAL

[75] Inventors: Hans I. Elvander, Helsingborg; Rolf E. Malmström, Helsingfors, both of Sweden

[73] Assignee: A. Ahlstrom Corporation, Noormarkku, Finland

[21] Appl. No.: 323,708

[22] Filed: Mar. 15, 1989

[30] Foreign Application Priority Data

Mar. 30, 1988 [FI] Finland ..... 881486

[51] Int. Cl.[5] ..... C22B 5/14; C22B 5/08

[52] U.S. Cl. ..... 75/23; 423/48; 423/88; 266/157; 266/172; 75/694

[58] Field of Search ..... 75/23, 26, 69, 70, 74, 75/77, 82, 84, 86; 266/172, 157

[56] References Cited

U.S. PATENT DOCUMENTS

| | | | |
|---|---|---|---|
| 4,073,645 | 2/1978 | Fritsch et al. | 75/74 |
| 4,087,274 | 5/1978 | Edenwall et al. | 75/91 |
| 4,414,022 | 11/1983 | Melcher | 75/26 |
| 4,740,240 | 4/1988 | Sulzabacher et al. | 75/23 |
| 4,802,917 | 2/1989 | Victorovich et al. | 75/74 |

OTHER PUBLICATIONS

Sychev et al., "Oxygen Electrothermal Method . . . (Torch Smelting)", Latest Development in the Mining and Processing of . . . , pp. 191-196, (1975).

25 *Proceedings Nauka of Kazakhstan* Alma Ata; USSR Ministry of Nonferrous Industry.

*Primary Examiner*—Melvyn J. Andrews

*Attorney, Agent, or Firm*—Nixon & Vanderhye

[57] ABSTRACT

Method and apparatus for producing matte and/or metal from sulphidic fine-grained ore or ore concentrate. The ore or ore concentrate is smelted in a flame chamber in such a way that at least part of the solid material in the flame chamber melts and flows downward into a smelt bath furnace, on top of which the flame chamber is disposed. Volatile metallic and sulphuric components are conducted upward from the flame chamber to a fluidized bed reactor to be utilized as fluidizing gas, the gases being rapidly cooled down in the fluidized bed.

12 Claims, 1 Drawing Sheet

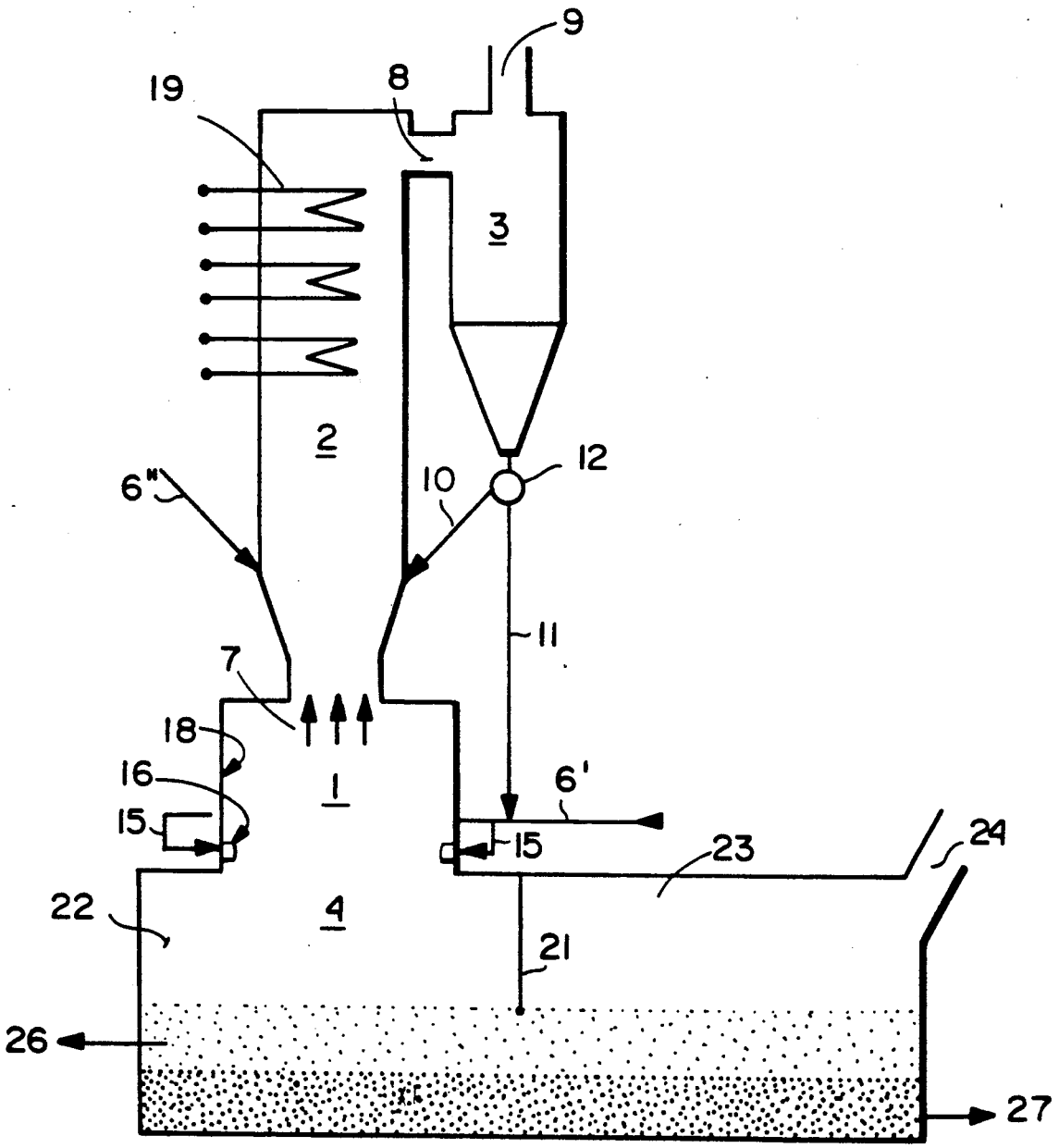
9
19
8
3
2
12
6"
10
11
7
18
16
1
6'
15
15
23
24
22
4
21
26
27

METHOD AND APPARATUS FOR PRODUCING MATTE AND/OR METAL

The present invention relates to a method for producing matte and/or metal from sulphidic fine-grained ore or sulphidic ore concentrate in a reactor consisting of a flame chamber and a gas cooler. The present invention also relates to an apparatus for carrying out the method.

The production of matte can be carried out by various methods of suspension-smelting. In flame-smelting, ore or ore concentrate is supplied together with air into a downward shaft, whereby oxidation reactions at a high temperature take place. The reaction products are conducted down to a smelt bath furnace underlying the shaft. In flame-smelting the objective is to run the processes autogenously so that the heat generated in the reaction will suffice for heating the reaction products and for maintaining the temperature required for the reaction. The processes are carried out by taking out the gases via the smelt bath furnace section, which has in some cases turned out to be a drawback. Among other things, the atmosphere of the smelt bath furnace may have a negative effect on the slag and/or the gas and the dust entrained by the gas. The volatile components present in the gas may, on the other hand, affect the slag or the matte in the smelt.

It is also known to smelt ore concentrate in an oxidizing atmosphere in a smelt-cyclone, as disclosed in U.S. Pat. No. 4,414,022. The gases from the smelt-cyclone are also in this case conducted down to the smelt bath furnace together with the smelt, and being discharged therefrom through a separate tap hole.

In smelting sulphidic concentrates, problems with exhaust gases arise, as these have a strong tendency to sinter and thus impede the heat recovery from the exhaust gases. E.g., in smelting lead-containing concentrate, a Pb-PbO-saturated flue gas containing $SO_2$ will form at 1200° C.–1300° C. When the gas is cooled, Pb and PbO will condense, while the chemical balance shifts in such a way that lead sulphate is formed at 900° C.–500° C. and is separated from the gas in the form of a mist. The conditions are particularly favourable for the formation of sulphate on heat transfer surfaces, which will thus be covered with sulphate layers. The tendency for other dust to sinter in the flue gases increases because of the formation of sulphate, this being thus a common problem in most smelting processes where sulphidic concentrates are smelted, and where vapours of lead, copper, zinc, nickel and the like are formed, which in turn may form sulphates when the gas is cooled down. The problems are accentuated in processes where oxygen-enriched air or pure oxygen are used, as high temperatures develop in these processes, at which the $SO_2$-concentrations rise causing subsequent sulphate formation. Copper concentrates with even higher contents of lead and zinc are being utilized, which results in increasing the contents of vapourizing components and sulphates in the process gases, and consequently, in increasing the problems of fouling of the heat transfer surfaces.

It is an object of the present invention to provide a more simple method than previously known for utilizing the heat from the exhaust gases.

It is also an object of the invention to provide a method in which less and, at the same time, purer exhaust gases are formed.

The problem with the processes described above has been solved in a surprisingly simple manner by the present invention by (a) blowing the ore or ore concentrate into a flame chamber together with oxidizing agent, which causes sulphur and readily-oxidizing metals to oxidize freeing energy and causing at least part of the solid material in the flame chamber to melt and be separated on the walls of the flame chamber and flow downward to a smelt bath furnace or a collecting chamber for slag and matte, (b) conducting $SO_2$-containing gases formed in the flame chamber upward to the gas cooler to be utilized as fluidizing gases, the cooler consisting of a fluidized bed reactor, causing thus the gases and the solid and molten particles entrained by the gases to rapidly cool down in the fluidized bed, (c) separating the cooled particles from the gases in a particle separator and (d) recirculating part of the separated particles to the fluidized bed.

The production of matte and/or metal of sulphidic fine-grained ore or ore concentrate can, according to the present invention, be carried out in an apparatus comprising (a) a flame chamber, the upper portion of which is connected to a gas cooler, and the lower portion of which is connected to a smelt bath furnace for slag and matte, and which has at least one inlet for ore and/or ore concentrate plus oxidizing agent (b) a gas cooler consisting of a fluidized bed reactor, the lower portion of which is connected to the flame chamber and the upper portion of which is connected to a particle separator, (c) a particle separator having an outlet for cleaned gases and an outlet for separated particles, the outlet for the particles being connected, by a first line for recirculation of material to the fluidized bed reactor, and by a second line to the flame chamber.

The reaction-kinetics in the method according to invention is approximately the same as in other suspension-smelting processes. The difference lies in the fact that the gases from the smelting process are not removed from the smelt bath furnace but are separated from the smelt and taken directly to the cooling stage.

Thus the atmosphere of the smelt bath furnace, which might be different of that of the flame chamber, e.g., because of an auxiliary burner in the furnace, will not affect the gas and the dust being entrained by the gas. In the underlying furnace, the oxidation degree of the dust might be changed in an undesirable direction and, e.g., the volatile metals in the dust might be over-oxidized and form less volatile components.

By conducting the gas directly out of the flame chamber, the contamination of the slag or matte by the volatized, undesirable components is prevented.

The composition of the gas can be better controlled in the method according to the invention. The addition of hydrocarbons or oxygen makes it possible to control the reactions in the gas. This is of significance, e.g., in the removal of As and Sb from ore concentrate.

In the flame chamber, a mixing of the reaction components is brought about, causing exchange reactions between over-oxidized particles and those where non-reacted material is still present. Small particles in a suspension will easily be over-oxidized, as the reactions in them take place more rapidly than in the larger particles, which will thus not be completely oxidized. In a conventional flash-smelter, the exchange reactions, which are endothermal, take place only in the smelt bath underlying the shaft, the temperature of the smelt falling by 50° C.-100° C.

An apparatus according to the invention may be accomplished by rebuilding an existing flame or electric furnace. The space requirement for the apparatus is fairly small. By taking the gas directly out of the flame chamber, and not via the relatively untight furnace, a more concentrated $SO_2$-gas is obtained. The gas space in the underlying furnace can be divided into two sections by a partition wall, whereby the gases rich in $SO_2$ can be withdrawn from the first section through the flame chamber, and those having the lowest possible content of $SO_2$ can be withdrawn from the second section through the gas outlet of the furnace out in the atmosphere.

In the following, the invention is described with reference to the figure, which shows schematically an apparatus for carrying out the invention.

The apparatus consists mainly of a flame chamber 1 and a fluidized bed reactor 2 disposed on top of it and connected to a particle separator 3. The flame chamber is disposed on top of a furnace 4, which in turn is connected to the lower portion of the flame chamber through an opening.

Sulphidic ore or ore concentrate 6' is blown into the flame chamber together with oxidizing agent through an inlet 15 in the wall of the flame chamber. Sulphur and readily-oxidizing metals will be oxidized in the flame, thereby freeing energy. The oxidizing agent can be air, oxygen-enriched air or pure oxygen. By adjusting the content of oxygen gas in the oxidizing agent, it is possible to affect the temperature or the degree of metallization of the molten material.

The ore or ore concentrate is preferably supplied into the flame chamber in such a manner that the material is brought into a rotating movement about an imagined vertical axle, thus causing an extended retention time in the flame chamber for the suspension of particles and gas. At the same time, a good separation of particles and gas is obtained. According to an advantageous embodiment of the invention, the ore or ore concentrate is fed into the flame chamber secantially. The material is suitably supplied via at least two nozzles 16 located on different sides of the flame chamber. The material is supplied in such a manner that the gases are brought into a rotating movement in order to prevent the gases from being directly blown out from the centre of the flame chamber.

The heating of the material takes place in the flame, at least part of the solid material supplied melting in the flame chamber. The rotating movement causes a centrifugal separation, whereby the molten and solid material is slung against the walls of the flame chamber. The material then flows downward into the smelt bath furnace or collecting chamber for slag and matte.

The walls in the flame chamber can be cooled, causing a solid layer to be formed close to the wall. By low loads, a thick layer is formed close to the wall, which results in decreased cooling in the flame chamber. By high loads, a thinner layer is formed resulting in a corresponding degree of increase in the cooling in the flame chamber.

The gases formed in the flame chamber are conducted upward to the gas cooler 2 to be utilized as fluidizing gases, the gas cooler consisting of a fluidized bed reactor. In the fluidized bed, the gases and the vapourized and molten particles plus fine dust entrained by the gases will rapidly cool down when brought into contact with the circulating material present in the cooler. The gas is suitably cooled down to a temperature of 700° to 900° C. A sufficient amount of material circulates in the gas cooler for rapidly cooling the incoming gas down to temperature where no sintering or layer formation on the heat transfer surfaces occurs any longer. The gases and the circulating material in the cooler is conducted upwardly in the gas cooler passing the heat transfer surfaces 19, where the cooling of the gas and the particles continues. In order to avoid undesirable sulphatizing of the dust in the gases, it is in most cases advantageous to drop the temperature down to 600°-700° C., at which temperature sulphatizing slows down. The sulphatizing reactions may cause undesirable rise of the temperature. Sulphatizing binds sulphur, which is not desirable as the objective in most cases is to recover all the sulphur in the form of $SO_2$.

According to the method of the invention, it is possible to adjust the temperature of the material supplied with the gases into the fluidized bed to one which is advantageous from the point of view of the metallurgic process. E.g., in the flame-smelting of impure Cu-concentrate, a process gas is formed which contains valuable metals, such as Cu, Zn, and Pb plus possibly Fe. By adjusting the temperature and by adjusting the oxygen potential of the reactor to a sufficiently high level, it is possible to achieve conditions under which the valuable metals, Cu, Zn, and Pb form water-soluble sulphates, the iron remaining in oxide form. By controlling the amount of particles and the oxygen potential in the reactor, optimal conditions for various metallurgic processes can be reached. In addition, it is possible to recover heat from both the smelting process and the sulphatizing reactions in the form of high pressure vapour by conducting the cleaned gas to a heat recovery boiler.

The gases and the bed particles are withdrawn from the gas cooler through a channel 8 to a particle separator 3, where the bed particles are separated from the gases, which are withdrawn via an outlet 9. The separated particles are returned to the gas cooler via an outlet 12 and a channel 10, or via a channel 11 into the flame chamber. By the method according to the invention, the dust from the gas cleaning stage in the separator 3 can be rapidly returned to the process in the flame chamber.

It is possible to feed part of the ore or ore concentrate into the gas cooler through an inlet 6'' in order to thus preheat the material and recover part of the heat energy of the gases. The preheated material is then conducted, after separation in the particle separator 3, via the channel 11 to an inlet 15 of the flame chamber. Ore concentrate containing volatile Sb, Bi, and/or As is suitably preheated to a temperature at which these volatile substances are already removed in the fluidized bed reactor in the form of volatile sulphides together with the gases, prior to the ore concentrate being supplied to the flame chamber. When required, the oxygen potential in the system can be adjusted by adding hydrocarbons or air. The reaction temperature is preferably above 700° C. for an optimal removal of volatile sulphides. The temperature is also dependent on the sintering properties of the material supplied.

Slag former may be fed directly into the flame chamber through inlet 15 or through separate inlets. The slag former can be preheated, if desired, and is in that case fed into the gas cooler 2 and conducted via the particle separator 3 and channel 11 into the flame chamber. It is very simple, according to the method of the invention, to return the dust being removed together with the gases while the cleaning of the gases is very efficient.

The matte, metal and slag being formed flows down to the collecting chamber or the smelt bath furnace below the flame chamber. The smelt bath furnace may be, e.g., a flame or electric furnace. The gas space of the smelt bath furnace is divided into a first chamber 22 and a second chamber 23 by a partition wall 21. The first chamber is disposed underneath the flame chamber, whereby the gases from the first chamber rise up to the flame chamber. These gases may still contain fairly high contents of $SO_2$ and are suitably withdrawn together with the gases from the flame chamber. The second chamber incorporates a gas outlet 24 for combustion gases that do not contain significant amounts of $SO_2$. $SO_2$ is mostly formed in the flame chamber and is withdrawn from it via the gas cooler. In addition, the gas from the first chamber of the smelt bath furnace, where $SO_2$ can still be formed is withdrawn via the flame chamber. The atmosphere in the two gas chambers 22 and 23 of the smelt bath furnace may be different, depending on the processes and whether or not an auxiliary burner is used in the latter section of the smelt bath furnace. The apparatus according to the invention is easy to run up and down as not heating of the shaft is required, contrary to a conventional flash-smelter.

What is claimed is:

1. A method for producing matte and/or metals from sulphidic fine-grained ore or ore concentrate utilizing a gas cooler comprising a fluidized bed reactor having a bottom which is open to a flame chamber having walls, a collecting means adjacent the bottom of the flame chamber, and a particle separator connected to the fluidized bed materials, the method comprising the steps of:

(a) blowing the ore or ore concentrate into the flame chamber, together with an oxidizing agent so as to cause sulfur and readily oxidizing metals in the ore or ore concentrate to oxidize thereby generating $SO_2$-containing gases, freeing energy and causing at least part of the ore or ore concentrate in the flame chamber to melt into molten particles, be separated on the walls of the flame chamber and flow downwardly to the collecting means;

(b) conducting the $SO_2$-containing gases formed in the flame chamber upwardly to the gas cooler fluidized bed reactor and introducing the gases as fluidizing gases in the fluidized bed reactor, rapidly cooling the gases and particles of ore or ore concentrate and molten particles entrained by the gases in the fluidized bed;

(c) separating the cooled particles from the gases in the particle separator; and (d) recirculating at least part of the separated particles to the fluidized bed.

2. The method according to claim 1, comprising the additional step (e) of feeding slag former into the flame chamber.

3. The method according to claim 1, comprising the additional step (e) of returning part of the separated particles to the flame chamber.

4. The method according to claim 2 wherein step (e) is practiced by heating the slag former in the fluidized bed reactor prior to being introduced into the flame chamber.

5. The method according to claim 3 comprising the additional step (f) of preheating a portion of the ore or ore concentrate in the fluidized bed reactor before blowing the ore or ore concentrate into the flame chamber.

6. The method according to claim 5 wherein step (f) is practiced by heating the ore or ore concentrate in the fluidized bed reactor up to a temperature at which volatile Sb, Bi and/or As are removed together with the gases.

7. The method according to claim 1, wherein step (b) is practiced by cooling the gases and entrained particles to a temperature of between 600° and 700° C.

8. The method according to claim 1, wherein step (a) is practiced by blowing air into the flame chamber as the oxidizing agent.

9. The method according to claim 1 wherein step (a) is practiced by blowing oxygen gas into the flame chamber as the oxidizing agent.

10. The method according to claim 1 wherein step (a) is practiced by imparting a rotation to ore and ore concentrate blown into the flame chamber.

11. The method according to claim 10 wherein the ore or ore concentrate is blown secantially into the flame chamber and through at least two feed nozzles.

12. A method for producing matte and/or metals from sulphidic fine-grained ore or ore concentrate utilizing a fluidized bed reactor having an upper and lower portion, a flame chamber mounted below the fluidized bed having walls and a lower portion, a smelt bath furnace below the flame chamber, and a particle separator connected to the fluidized bed, the method comprising the steps of:

(a) blowing the ore or ore concentrate together with oxygen-enriched air into the lower portion of the flame chamber, oxidizing readily oxidizing metals in the ore or ore concentrate in the flame chamber to generate $SO_2$-containing gases, and melting at least part of the ore or ore concentrate in the flame chamber into molten particles of slag and matte;

(b) rotating the flow of ore or ore concentrate within the flame chamber to cause the slag and matte to impinge upon the wall of the flow chamber, separating the molten slag and matte on the wall and allowing the molten slag and matte to flow down the wall to the smelt bath furnace;

(c) conducting $SO_2$-containing gases and entrained fine solid particles from the flame chamber upwardly to the fluidized bed reactor and introducing the gases as fluidizing gases in the fluidized bed reactor;

(d) cooling the gases and entrained fine solid particles in the fluidized bed down to a temperature between 750° and 900° C. in the lower portion of the fluidized bed, and down to between 600° and 700° C. in the upper portion of the fluidized bed;

(e) separating the cooled fine solid particles from the gases in the particle separator; and (d) recirculating a portion of the separated particles to the lower portion of the fluidized bed and feeding another portion of the separated particles to the flame chamber.

* * * * *